US009702147B2

(12) United States Patent
Babson et al.

(10) Patent No.: US 9,702,147 B2
(45) Date of Patent: Jul. 11, 2017

(54) PANELS FOR FRAMING AND CONSTRUCTING A BUILDING STRUCTURE

(71) Applicant: Clifford Eugene Babson, Lansing, NY (US)

(72) Inventors: Clifford Eugene Babson, Lansing, NY (US); Glynn Morgan Bebee, Ithaca, NY (US)

( * ) Notice: Subject to any disclaimer, the term of this patent is extended or adjusted under 35 U.S.C. 154(b) by 0 days.

(21) Appl. No.: 14/147,543

(22) Filed: Jan. 5, 2014

(65) Prior Publication Data

US 2014/0190105 A1 Jul. 10, 2014

Related U.S. Application Data

(60) Provisional application No. 61/749,867, filed on Jan. 7, 2013.

(51) Int. Cl.

| | |
|---|---|
| ***E04C 2/24*** | (2006.01) |
| ***E04B 5/02*** | (2006.01) |
| ***E04B 5/12*** | (2006.01) |
| ***E04B 1/26*** | (2006.01) |
| *E04C 2/38* | (2006.01) |
| *E04B 2/70* | (2006.01) |

(52) U.S. Cl.

CPC ..... *E04C 2/243* (2013.01); *E04B 1/26* (2013.01); *E04B 5/02* (2013.01); *E04B 5/12* (2013.01); *E04C 2/386* (2013.01); *E04B 2/707* (2013.01); *E04C 2/384* (2013.01); *E04C 2/388* (2013.01)

(58) Field of Classification Search

CPC . E04C 2/296; E04C 2/384; E04C 2/22; E04C 2/292; E04C 2/386; E04C 2/388; E04C 2/205; E04C 2/288; E04C 2/521; E04C 2/243; E04C 2/36; E04C 2/06; E04C 2/322; E04C 2/20; E04C 5/12; E04C 5/02; E04B 1/80; E04B 1/26; E04B 1/34321; E04B 1/7654; E04B 2001/34389; E04B 2001/3583; E04B 2/707; E04B 7/22

USPC ..... 52/309.1, 309.4, 309.5, 309.7, 309.8, 52/309.9, 309.13, 309.14, 309.15, 309.16, 52/794.1, 309.11, 220.1, 220.2

See application file for complete search history.

(56) References Cited

U.S. PATENT DOCUMENTS

| | | | | | |
|---|---|---|---|---|---|
| 1,767,168 | A | * | 6/1930 | Burt, Jr. | 52/406.2 |
| RE21,905 | E | * | 9/1941 | Nielsen et al. | E04C 2/044 52/127.2 |
| 3,353,315 | A | * | 11/1967 | Barker | E04C 2/22 428/167 |
| 3,399,503 | A | * | 9/1968 | Dyer et al. | 52/406.1 |
| 3,421,270 | A | * | 1/1969 | Chaney | E04B 7/04 52/105 |

(Continued)

OTHER PUBLICATIONS http://www.insulwall.com/ Insulwall product A website which describes a product they call Insualwall which are insulation that are inserted into a studded wall framed on-site in a traditional manner. The panels are small, sized to the size of a standard wall cavity, and are designed as an insert component in a standard wall.

(Continued)

*Primary Examiner* — James Ference

(57) ABSTRACT

An insulated panel having grooves and channels therein to serve as a template for the proper placement of framing members in the construction of a building structure such as a dwelling or commercial building.

2 Claims, 11 Drawing Sheets

(56) References Cited

U.S. PATENT DOCUMENTS 3,466,831 A * 9/1969 Lenoir ..... 52/521
3,583,123 A * 6/1971 Holmgren et al. ..... 52/588.1
3,641,724 A * 2/1972 Palmer ..... E04C 2/386 156/78
3,729,889 A * 5/1973 Baruzzini ..... E04B 1/6162 52/264
3,732,138 A * 5/1973 Almog ..... 428/114
4,068,434 A * 1/1978 Day ..... E04C 2/386 52/220.1
4,255,915 A * 3/1981 Muriotto ..... 52/601
4,290,246 A * 9/1981 Hilsey ..... E02D 27/02 52/125.3
4,296,162 A * 10/1981 Jean ..... 428/213
4,500,592 A * 2/1985 Lee et al. ..... 442/230
4,578,909 A * 4/1986 Henley ..... E04B 1/74 52/210
4,612,748 A * 9/1986 Arnold et al. ..... 52/309.16
4,628,650 A * 12/1986 Parker ..... E04B 1/14 52/265
4,641,468 A * 2/1987 Slater ..... 52/309.4
4,674,253 A * 6/1987 Young ..... E04C 2/386 52/236.9
4,702,046 A * 10/1987 Haugen ..... E04B 1/10 181/286
4,702,058 A * 10/1987 Bennett ..... E04C 2/288 52/309.11
4,720,948 A * 1/1988 Henley ..... E04B 1/74 52/404.3
4,780,347 A * 10/1988 Cohen ..... 428/34.2
4,815,243 A * 3/1989 Pardo ..... E04F 17/00 174/505
4,842,908 A * 6/1989 Cohen et al. ..... 428/34.2
4,878,323 A * 11/1989 Nelson ..... E04B 7/04 52/127.2
4,894,974 A * 1/1990 Mayhew ..... E04C 2/36 52/668
4,941,304 A * 7/1990 Lewellin ..... 52/580
4,946,732 A * 8/1990 Cohen et al. ..... 428/192
4,953,334 A * 9/1990 Dickens ..... 52/309.4
4,986,052 A * 1/1991 Nelson ..... E04B 7/045 52/745.06
5,027,574 A * 7/1991 Phillip ..... 52/171.3
5,067,296 A * 11/1991 Brown ..... E04C 2/386 52/295
5,079,885 A * 1/1992 Dettbarn ..... E04B 2/707 52/282.1
5,104,701 A * 4/1992 Cohen et al. ..... 428/34.5
5,224,315 A * 7/1993 Winter, IV ..... 52/309.8
5,245,809 A * 9/1993 Harrington ..... 52/309.11
5,269,109 A * 12/1993 Gulur ..... 52/309.9
5,285,609 A * 2/1994 Goad ..... 52/588.1
5,353,560 A * 10/1994 Heydon ..... B26D 3/006 52/241
5,373,674 A * 12/1994 Winter, IV ..... 52/309.9
5,373,678 A * 12/1994 Hesser ..... 52/592.1
5,638,651 A * 6/1997 Ford ..... 52/309.7
5,701,708 A * 12/1997 Taraba ..... E04B 1/14 52/210
5,765,330 A * 6/1998 Richard ..... E04C 2/386 52/265
5,771,645 A * 6/1998 Porter ..... E04C 2/243 29/897
5,787,665 A * 8/1998 Carlin et al. ..... 52/309.4
5,799,462 A * 9/1998 McKinney ..... 52/742.13
5,815,989 A * 10/1998 Bennenk et al. ..... 52/80.1
5,822,940 A * 10/1998 Carlin ..... E04C 2/384 52/309.4
5,842,276 A * 12/1998 Asher et al. ..... 29/897.32
5,842,314 A * 12/1998 Porter ..... 52/309.7
5,893,248 A * 4/1999 Beliveau ..... 52/309.7
5,953,883 A * 9/1999 Ojala ..... E04B 1/26 52/220.1
6,026,628 A * 2/2000 Lopez ..... E04B 2/84 52/309.12
6,026,629 A * 2/2000 Strickland et al. ..... 52/794.1
6,042,911 A * 3/2000 Berdan, II ..... 428/36.3
6,044,603 A * 4/2000 Bader ..... 52/309.7
6,083,603 A * 7/2000 Patel et al. ..... 428/128
6,085,485 A * 7/2000 Murdock ..... 52/783.19
6,096,416 A * 8/2000 Altenberg ..... 428/317.7
6,164,035 A * 12/2000 Roberts ..... 52/563
6,167,624 B1 * 1/2001 Lanahan et al. ..... 29/897.32
6,182,407 B1 * 2/2001 Turpin et al. ..... 52/232
6,191,057 B1 * 2/2001 Patel et al. ..... 442/398
6,226,943 B1 * 5/2001 Grinshpun ..... E04B 1/80 52/309.4
6,240,704 B1 * 6/2001 Porter ..... 52/794.1
6,263,628 B1 * 7/2001 Griffin ..... 52/309.12
6,308,491 B1 * 10/2001 Porter ..... 52/794.1
6,408,594 B1 * 6/2002 Porter ..... 52/794.1
6,463,702 B1 * 10/2002 Weaver ..... E04B 1/04 52/236.9
6,481,172 B1 * 11/2002 Porter ..... 52/506.01
6,571,523 B2 * 6/2003 Chambers ..... E04B 1/14 52/270
6,698,157 B1 * 3/2004 Porter ..... 52/794.1
6,711,872 B2 * 3/2004 Anderson ..... 52/783.17
6,854,230 B2 * 2/2005 Starke ..... E04C 2/521 52/241
6,892,507 B1 * 5/2005 Pease ..... 52/794.1
6,931,809 B1 * 8/2005 Brown et al. ..... 52/409
7,107,731 B2 * 9/2006 Record ..... 52/309.9
7,398,620 B1 * 7/2008 Jones ..... E04B 7/045 52/643
7,568,318 B1 * 8/2009 Egan ..... E04C 2/52 52/210
8,028,483 B2 * 10/2011 Carolan ..... 52/404.1
8,046,971 B2 * 11/2011 Lima ..... E04C 2/296 52/309.7
8,151,539 B2 * 4/2012 Grinsted ..... E04C 2/205 52/220.2
8,272,182 B1 * 9/2012 Spiegel ..... E04B 1/24 52/404.2
8,316,612 B2 * 11/2012 Dickens ..... E04B 1/90 52/220.2
8,438,792 B2 * 5/2013 Schwartz ..... E04B 1/7654 52/404.1
2002/0136888 A1 * 9/2002 Porter ..... 428/319.1
2002/0139082 A1 * 10/2002 DeFord et al. ..... 52/783.1
2003/0033774 A1 * 2/2003 Porter ..... 52/309.7
2003/0056456 A1 * 3/2003 Heydon ..... 52/415
2004/0068948 A1 * 4/2004 Wrass ..... 52/309.7
2004/0244335 A1 * 12/2004 Babbitt et al. ..... 52/796.1
2005/0042416 A1 * 2/2005 Blackmon et al. ..... 428/116
2005/0055982 A1 * 3/2005 Medina ..... 52/782.1
2005/0066587 A1 * 3/2005 Brisson ..... E04B 1/12 52/79.1
2005/0204697 A1 * 9/2005 Rue ..... 52/782.1
2005/0204699 A1 * 9/2005 Rue ..... 52/794.1
2005/0210760 A1 * 9/2005 Mower ..... E04B 1/34321 52/64
2005/0210761 A1 * 9/2005 Mower ..... E04B 1/12 52/64
2005/0210765 A1 * 9/2005 Mower ..... E04B 1/12 52/79.5
2005/0210766 A1 * 9/2005 Mower ..... E04B 1/34321 52/79.5
2005/0210828 A1 * 9/2005 Mower ..... E04B 1/34321 52/782.22
2005/0223652 A1 * 10/2005 Mower ..... E04H 1/1205 52/79.1
2005/0223653 A1 * 10/2005 Mower ..... E04B 1/34321 52/79.1
2005/0223655 A1 * 10/2005 Mower ..... E04B 1/34321 52/79.5
2005/0284060 A1 * 12/2005 Ritchie ..... 52/309.7
2005/0284061 A1 * 12/2005 Ritchie ..... 52/309.7
2005/0287338 A1 * 12/2005 Lubker, II ..... 428/131

(56) References Cited

U.S. PATENT DOCUMENTS

2006/0117689 A1* 6/2006 Onken ..... E04C 2/22 52/309.7
2006/0179782 A1* 8/2006 Cox ..... E04B 1/14 52/653.1
2006/0194494 A1* 8/2006 Lubker, II ..... 442/208
2006/0260268 A1* 11/2006 Ritchie ..... 52/783.1
2006/0265985 A1* 11/2006 Nichols ..... 52/309.8
2006/0276093 A1* 12/2006 Agrawal ..... 442/374
2006/0277852 A1* 12/2006 Mower ..... E04H 1/1205 52/270
2007/0033890 A1* 2/2007 Solomon et al. ..... 52/309.7
2007/0039262 A1* 2/2007 Forgy ..... 52/309.16
2007/0059516 A1* 3/2007 Vincent et al. ..... 428/319.1
2007/0141343 A1* 6/2007 Miller et al. ..... 428/408
2007/0193158 A1* 8/2007 Miller et al. ..... 52/309.9
2007/0209295 A1* 9/2007 Mower ..... E04B 1/34321 52/79.1
2007/0227086 A1* 10/2007 Beavers et al. ..... 52/309.7
2007/0256379 A1* 11/2007 Edwards ..... 52/309.9
2008/0193712 A1* 8/2008 Desjardins ..... 428/119
2008/0250740 A1* 10/2008 Miller ..... 52/309.7
2009/0044479 A1* 2/2009 Martens ..... E04C 2/288 52/649.3
2009/0100780 A1* 4/2009 Mathis et al. ..... 52/578
2009/0205277 A1* 8/2009 Gibson ..... E04B 7/22 52/309.9
2010/0005746 A1* 1/2010 Lemay ..... E04C 2/386 52/506.05
2010/0107539 A1* 5/2010 Martens ..... E04C 2/386 52/506.05
2010/0325999 A1* 12/2010 Devalapura ..... E04B 1/7654 52/506.05
2011/0047908 A1* 3/2011 Brusman et al. ..... 52/220.1
2011/0258944 A1* 10/2011 Radoane ..... 52/62
2012/0096785 A1* 4/2012 Weeks ..... E04B 1/08 52/220.1
2012/0186633 A1* 7/2012 Carolan et al. ..... 136/251
2013/0067758 A1* 3/2013 Fearon ..... E04C 2/284 33/528
2013/0086850 A1* 4/2013 Morrow ..... E04B 1/38 52/167.1

OTHER PUBLICATIONS http://www.themobuilt.com/Home_Page.html Thermobuilt product A website which describes a product called Thermobuild which is product very similar to the Insulwall product. Thermobuilt consists of components that are inserted into wall cavities as the wall is built on-site.

http://www.dynabilt.com/ Dynabilt Product A website which describes a product they call Dyanbilt which is a standard wall built in factory, using foam as the insulation material.

* cited by examiner

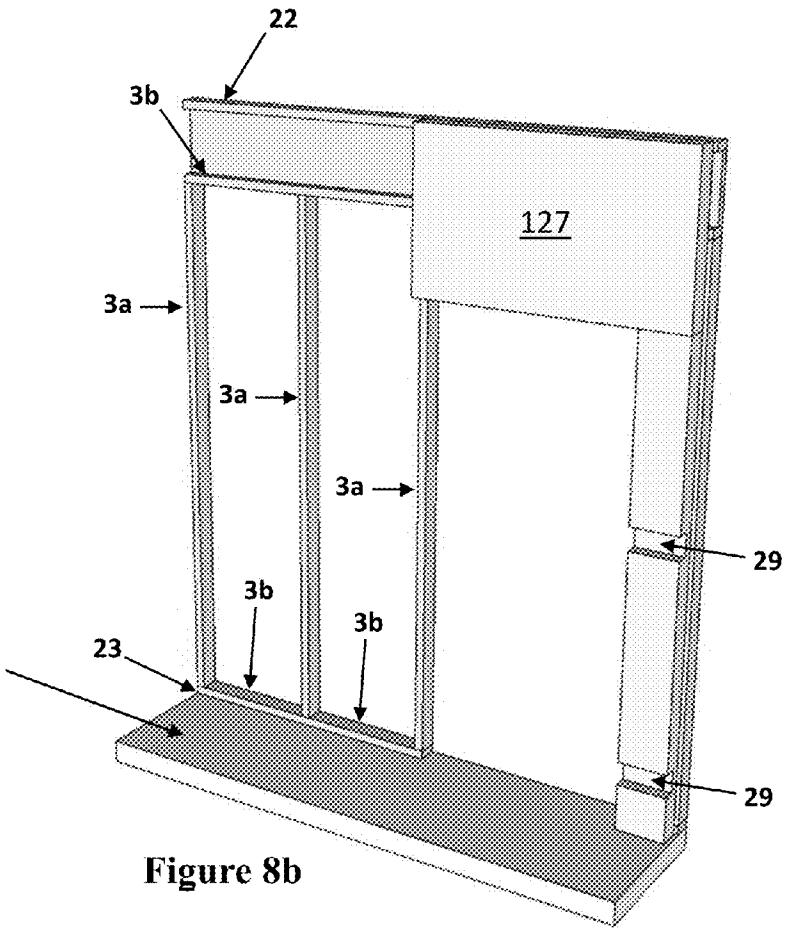
Figure 8b
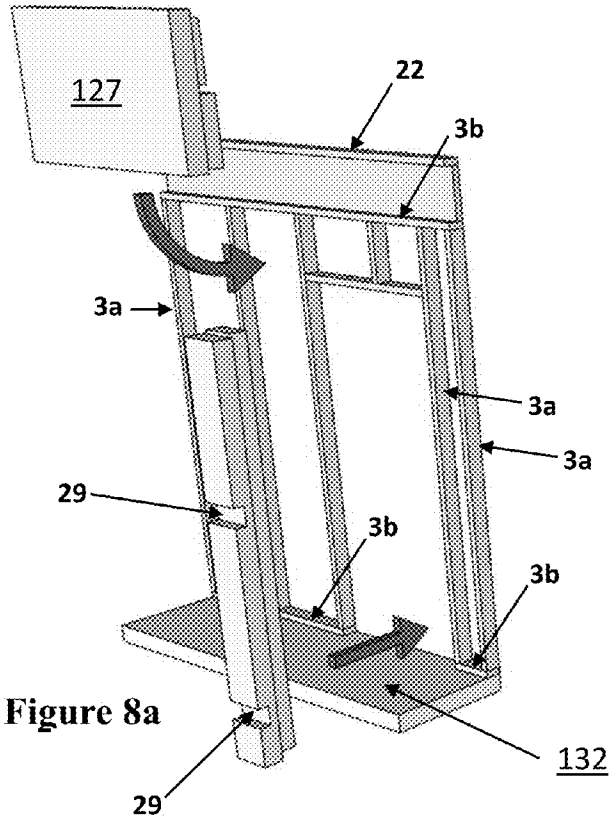
Figure 8a
Figure 8

Not Shown: #129 – Reference to Tools Used at #246

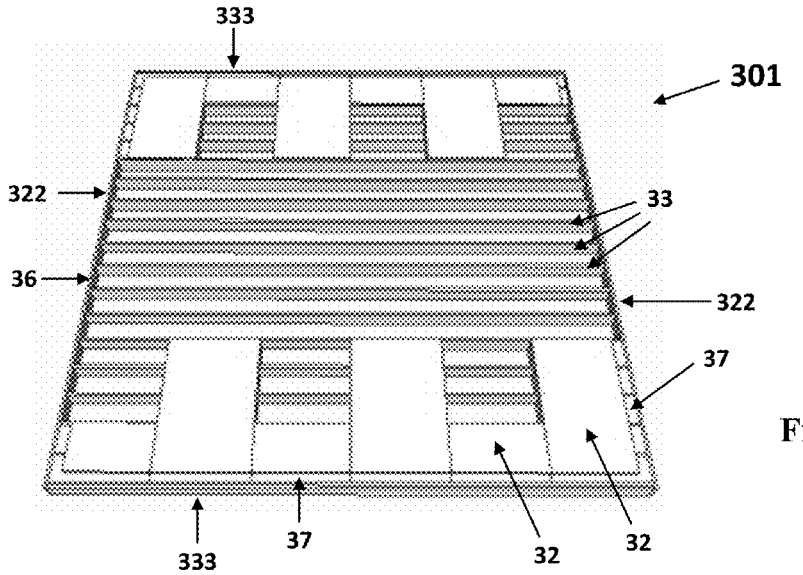
Figure 10a
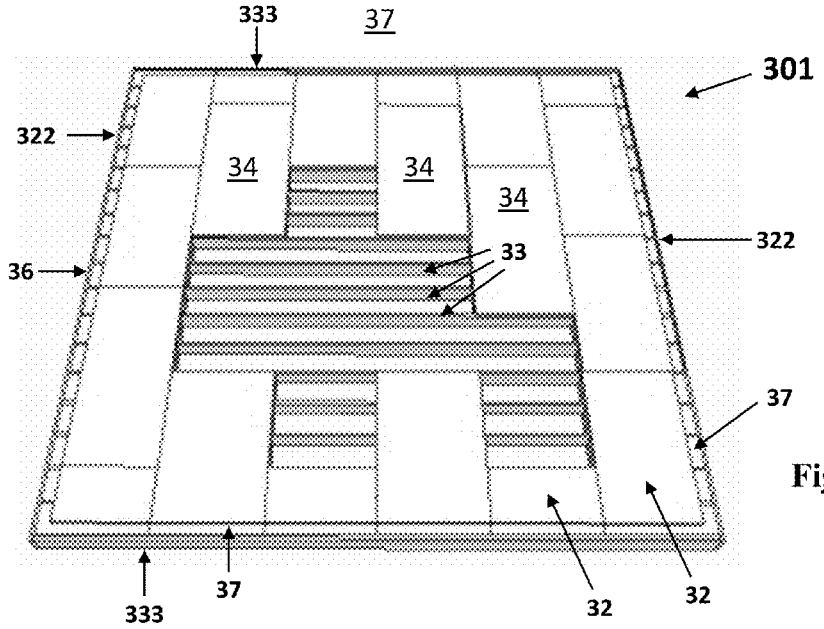
Figure 10b
Figure 10

PANELS FOR FRAMING AND CONSTRUCTING A BUILDING STRUCTURE

CROSS-REFERENCE TO RELATED APPLICATIONS

The present application claims priority under 35 U.S.C. §119(e) to U.S. Provisional Patent Application Ser. No. 61/749,867, entitled "Method of Framing and Constructing a Building Structure and Walls and Panels for Use in Such Construction," filed Jan. 7, 2013, the contents of which are hereby incorporated by reference in their entirety.

FIELD OF THE INVENTION

The present invention relates to a novel method of framing and constructing a building wall for a structure such as a dwelling or commercial building, and more particularly a method utilizing engineered, prefabricated panels having insulating qualities and having grooves and channels therein to aid in the framing of the walls. The present invention also relates to a building wall assembled according to the method of the present invention. The present invention also relates to a novel insulated panel for use in framing and constructing a building wall for a commercial or residential structure. The present invention also relates to insulated floor assemblies and ceiling panels for use in framing and constructing a commercial or residential structure. The present invention also relates to a method of constructing a dwelling or commercial building using the engineered, prefabricated panels of the present invention.

BACKGROUND OF THE INVENTION

There are various methods of constructing building structures using wood or metal framing "studs." There are also various methods of constructing building structures using prefabricated walls or prefabricated panels having insulating qualities such as Expanded Polystyrene or Styrofoam. Examples of such methods and products include Thermobuilt®, Insul-Wall®, and Dynabuilt®. However, each of these products and methods require special connecting means to secure wallboard to the interior, require special connecting means for securing siding to the exterior, use a less efficient framing system, and/or comprise uniform panels that are cut onsite by a building crew having particularly high level of skills in framing and construction.

Therefore, it is an object of the present invention to provide a method of constructing a building wall using engineered, prefabricated panels that provide insulating qualities to the structure, provide a simplified method of construction, provide a more efficient framing system, provide channels designed to received framing elements such as wood or metal studs and designed to act as a framing guide to the building crew thereby requiring only minimal skills for proper framing and construction, provide decreased labor costs, provide material efficiency and provide energy efficiency.

It is also an object of the present invention to provide an insulated building wall assembled according to the method of the present invention.

It is also an object of the present invention to provide an engineered, prefabricated insulated panel for use in the building method of the present invention.

It is also an object of the present invention to provide an insulated ceiling panel for use in the building method of the present invention.

It is also an object of the present invention to provide an insulated floor assembly for use in the building method of the present invention.

It is also an object of the present invention to provide any other building enclosure assemblies for use in the building method of the present invention.

It is also an object of the present invention to provide a building structure and method of constructing a building structure using the engineered, prefabricated insulated panels, ceiling panels and floor assembly of the present invention.

SUMMARY OF THE INVENTION

A method of framing and constructing a horizontal wall upon a floor assembly surface of a building structure, the method comprising the steps of: providing a series of framing members each having a length, a width, and a depth; providing an engineered, prefabricated, insulated panel comprising an exterior surface, an interior surface, a top edge, a bottom edge, and recessed framing channels for receiving and pre-positioning framing members such as wood or metal studs, the framing channels being located on the exterior surface of the panel and being recessed inward from the exterior surface of the panel, the framing channel having a length, a width, and a depth corresponding to the length, the width, and the depth of the framing members, and having an upper insulated course extending from the top horizontal framing channel to the top edge of the panel and comprising truss spaces capable of receiving the bottom chord at or near the heel of the roof truss or stringers of the upper floor; providing an adhesive suitable for securing the framing members within the framing channels; applying the adhesive in conjunction with mechanical fasteners to the framing members; inserting the framing members into the framing channels; allowing the adhesive to set-up such that the framing members are secured within the framing channels; and elevating the panel such that the vertical framing members are substantially perpendicular to the horizontal flooring surface 132, and the horizontal framing members are substantially parallel to the horizontal flooring surface 132.

A building wall assembled according to the method of the present invention.

An insulated panel for use in the method of the present invention.

An insulated floor assembly for use in the method of the present invention.

An insulated ceiling panel for use in the method of the present invention.

A building structure constructed using the insulated panels of the present invention.

BRIEF DESCRIPTION OF THE DRAWING

While the specification concludes with claims particularly pointing out and distinctly claiming the subject matter which is regarded as forming the present invention, it is believed that the invention will be better understood from the following description which is taken in conjunction with the accompanying drawings in which like designations are used to designate substantially identical elements, and in which:

FIGS. 8*a* and 8*b* are a series of perspective, interior views of the embodiment of FIGS. 7*a* and 7*b* showing an alternate embodiment of the door header in various stages of assembly;

FIG. 10 comprising FIGS. 10*a* and 10*b* perspective view of a preferred embodiment of an insulated flooring assembly of the present invention;

DETAILED DESCRIPTION OF THE INVENTION

Figure 1:
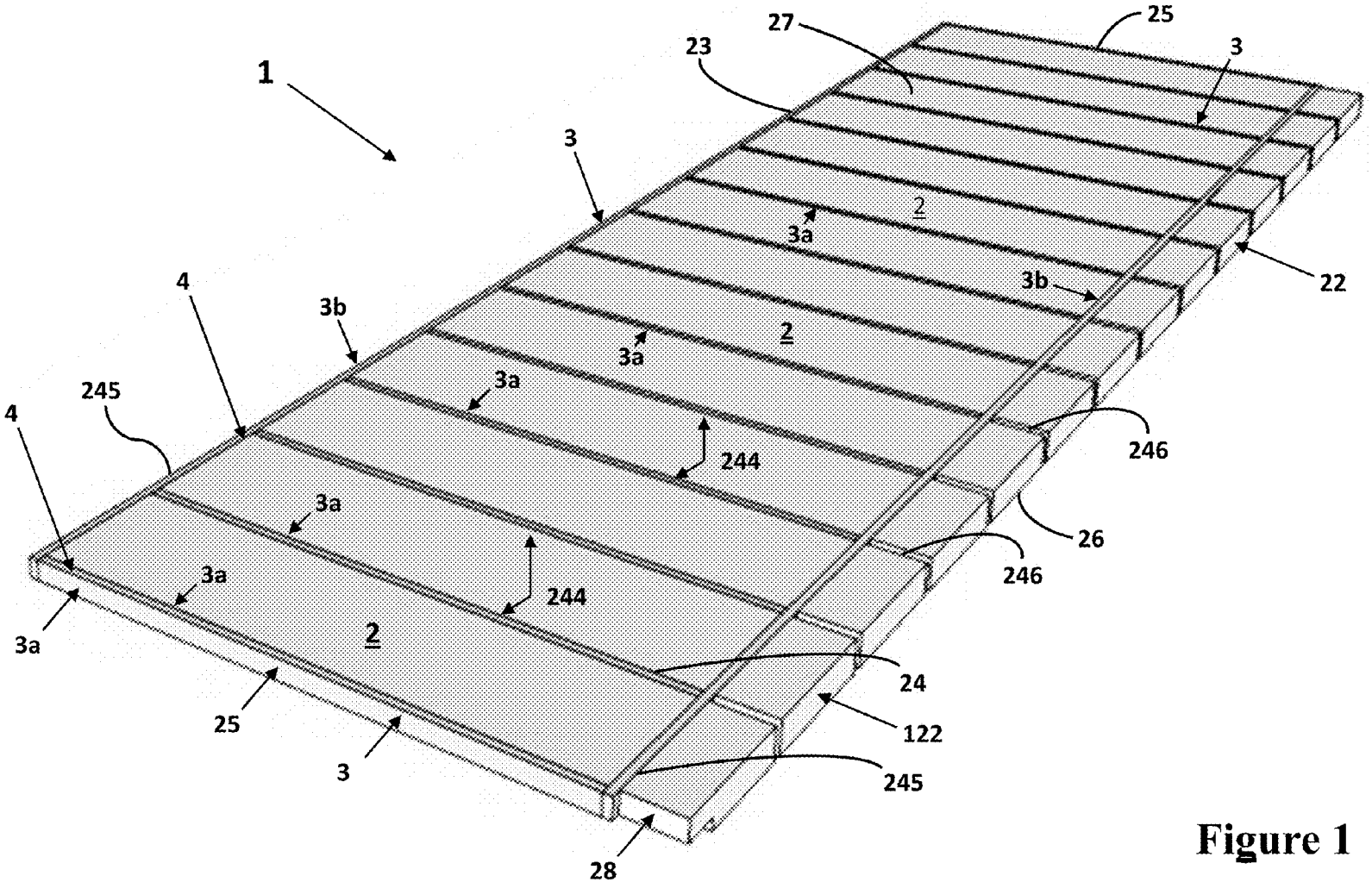
FIG. 1 is a perspective view of a preferred embodiment of the building wall of the present invention with the wall laying down flat and the exterior surface of the wall facing upward.

A preferred embodiment of the present invention, building wall 1 is shown in FIG. 1. Although the building wall of the present invention is described herein with reference to the wall of a small, single-story dwelling, it will be readily apparent to one skilled in the art that the method of the present invention may also be used to frame and construct larger buildings, multi-story buildings, and buildings other than dwellings.

Referring to FIG. 1, building wall 1 comprises an insulated panel 2 and framing members 3 joined to the insulated panel 2 by a securing means 4. As used herein, the term "joined" encompasses configurations whereby an element is directly secured to another element by affixing the element directly to the other element, and configurations whereby the element is indirectly secured to the other element by affixing the element to intermediate member(s) which in turn are affixed to the other element. As used herein, the term "insulated panel" refers to configurations comprising a single panel formed from a single, substantially uniform, piece of insulating material into which are formed the various channels and grooves of the building wall of the present invention, and also refers to configurations comprising a panel formed by securing together multiple pieces of insulating material. As used herein, the terms "fenestration" and "fenestrated opening" shall refer to openings in a structure including, but not limited to, windows, doors, louvers, vents, wall panels, skylights, storefronts, curtain walls, slope glazed systems, and the like.

Building wall 1 comprises a top edge 22, a bottom edge 23, framing channels 24, vertical side edges 25 which are substantially perpendicular to the top edge 22 and bottom edge 23, an interior surface 26, and an exterior surface 27. The building wall 1 comprises an insulated panel 2 comprising vertical framing channels 244 and horizontal framing channels 245. The vertical framing channels 244 are substantially perpendicular to the top edge 22 and bottom edge 23. The horizontal framing channels 245 are substantially parallel to the top edge 22 and bottom edge 23. The building wall 1 may comprise any number of vertical framing channels 244. The number of vertical framing channels 244 will be determined by the desired length of the building wall 1 and the desired spacing of the vertical framing members 3*a*.

In a preferred embodiment of the present invention, the insulated panel 2 will comprise vertical framing channels 244 which extend beyond the top horizontal framing member 245 to the top edge 122 of the insulated panel 2. The portions of the vertical framing channels 244 that extend from the top horizontal framing member 245 to the top edge 122 will form truss channels 246. The truss channels 246 are capable of receiving trusses or rafters to form a second level, e.g., a roof assembly or a floor assembly.

Many local building codes require frame structures to have vertical framing members or studs spaced with a maximum distance between the centerpoint of each stud and the adjacent stud(s). For example, many local building codes require that studs be spaced at a maximum distance of sixteen (16) inches between the centerpoint of each stud and the adjacent stud(s), i.e., sixteen (16) inches on center. The vertical framing members of the present invention may be spaced any distance that is suitable for the desired construction and/or required by local building codes. In a preferred embodiment of the present invention, the vertical framing members 3*a* and, therefore, the vertical framing channels 244 will be spaced twenty-four (24) inches on center.

The building wall 1 may comprise any number of horizontal framing channels 245. The number of horizontal framing channels 245 will be determined by the desired height of the building wall 1 and the desired spacing of the horizontal framing members 3*b*. The building wall 1 will preferably comprise at least two horizontal framing members 3*b* and, therefore, will comprise at least two horizontal framing channels 245. In a particularly preferred embodiment of the present invention, the building wall 1 will comprise two (2) horizontal framing members 3*b* positioned in two (2) horizontal framing channels 245. In the particularly preferred embodiment of building wall 1, one horizontal framing member 3*b* will run along the bottom edge 23 of the building wall 1 and the other horizontal framing member 3*b* will be near the top edge 22 of the building wall 1.

Figure 2:
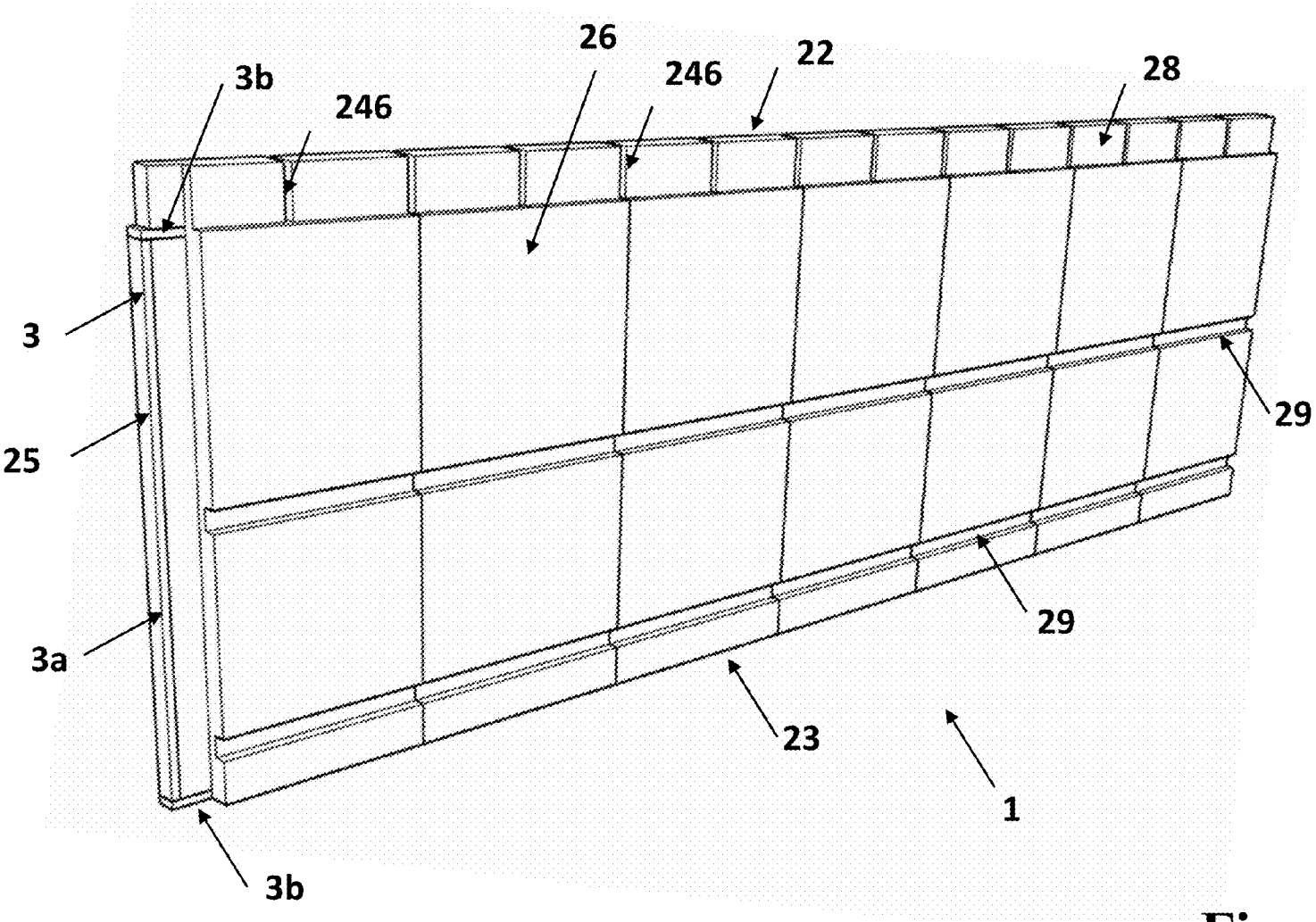
FIG. 2 is a perspective view of a preferred embodiment of the building wall of the present invention with the wall standing upright and with the interior surface showing.

Referring to FIG. 2, a particularly preferred embodiment of the building wall 1 of the present invention is shown in perspective view in its upright or vertical position with the interior surface 26 showing. The interior surface 26 of a particularly preferred embodiment of the building wall 1 of the present invention comprises mechanical grooves 29 for running electrical conduit, pluming, and other mechanicals of the building.

Figure 3:
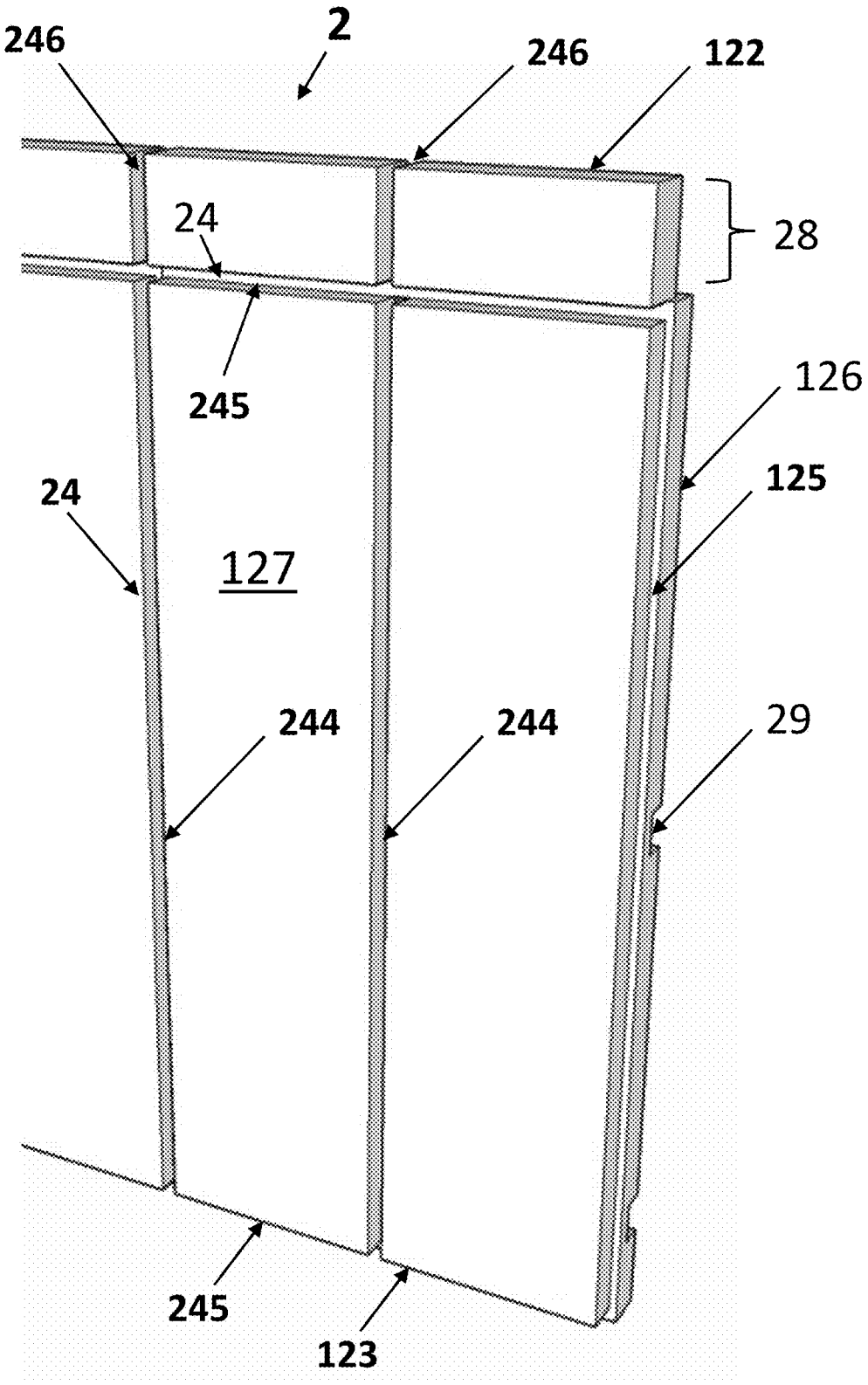
FIG. 3 is a perspective view of a preferred embodiment of the insulated panel of the present invention in the upright position with the exterior surface and framing channels of the panel showing.

Referring to FIG. 3, the insulated panel 2 comprises a top edge 122, a bottom edge 123, framing channels 24, vertical side edges 125 which are substantially perpendicular to the top edge 122 and bottom edge 123, an interior surface 126, and an exterior surface 127. The insulated panel 2 comprises vertical framing channels 244 and horizontal framing channels 245. The vertical framing channels 244 are substantially perpendicular to the top edge 122 and bottom edge 123. The horizontal framing channels 245 are substantially parallel to the top edge 122 and bottom edge 123. The insulated panel 2 may comprise any number of vertical framing channels 244. The number of vertical framing channels 244 will be determined by the desired length of the building wall 1 and the desired spacing of the vertical framing members 3*a*. The vertical framing channels 244 of the insulated panel 2 will be spaced to correspond to the desired spacing of the vertical framing members 3*a* of the building wall 1. In a preferred embodiment of the present invention, the vertical framing channels 244 of the insulated panel 2 will be spaced twenty-four (24) inches on center.

The insulated panel 2 may comprise any number of horizontal framing channels 245. The number of horizontal framing channels 245 will be determined by the desired height of the building wall 1 and the desired spacing of the horizontal framing members 3*b*. The building wall 1 will preferably comprise at least two horizontal framing members 3*b* and, therefore, will comprise at least two horizontal framing channels 245. In a particularly preferred embodiment of the present invention, the building wall 1 will comprise two (2) horizontal framing members 3*b* positioned in two (2) horizontal framing channels 245 with one horizontal framing member 3*b* running along the bottom edge 123 of the building wall 1 and the other horizontal framing member 3*b* being positioned near the top edge 122 of the building wall 1.

Referring to FIG. 3, the thickness of the insulated panel 2 is the distance measured from the interior surface 126 of the insulated panel 2 to the exterior surface 127 of the insulated panel. The insulated panel 2 also comprises an upper insulated course 28 that extends from the upper horizontal framing channel 245 to the top edge 122 of the insulated panel 2. The upper insulated course 28 will preferably be an extension of the insulated panel 2 and will have truss channels 246 provided to accept roof rafters for the roof trusses or, alternatively, to accept stringers for the next floor of the second level of the building structure. The upper insulated course 28 may comprise any number and configuration of truss channels 246. The number and configuration of truss channels 246 will be determined by the desired number of and desired spacing of roof trusses or floor stringers of the second level of the building structure.

The insulated panel 2 may be comprised of any material suitable for use in the construction of commercial or residential buildings, and which provides insulating qualities. A particularly preferred material for use in constructing the insulating panel 2 is Expanded Styrene Foam. Other suitable materials for the construction of the insulated panel 2 are well known to one skilled in the art and will be readily apparent to one skilled in the art. Examples of other suitable materials include other types of Polystyrene Foams such as Extruded Polystyrene, Polyurethane foams, cementitious foams, phenolic foams or any type of rigid insulating material having suitable properties, and capable of being formed, machined or tooled into the panels as described herein.

The framing members 3 may be comprised of any material suitable for use in the framing of commercial or residential buildings and should provide and structural support to the building wall 1 and, thereby, provide structural support to the finished building. In a preferred embodiment of the present invention, the framing members 3 will be comprised of wood, such as a wooden stud. A particularly preferred wooden stud for use as the framing member 3 of the present invention is a wooden stud known to those skilled in the art as a "2×4." A 2×4 stud may have a measurement of two (2) inches by four (4) inches, but most often has measurements slightly smaller than that, and usually has measurement of one and three quarter (1 ¾) inches by three and a half (3 ½) inches. Although the preferred embodiment of the framing members 3 of the present invention comprise standard 2×4 wooden studs, other sizes of wooden stud and materials other than wood are also envisioned. For example, the framing members 3 may be comprised of 1×3 wooden studs, 2×6 wooden studs, or any other wooden studs having suitable measurements for a particular building need. In addition, it is envisioned that non-wooden studs may also be used as the framing members 3 of the present invention. For example, studs constructed of metal, fiberglass, or other suitable materials are contemplated.

In a preferred embodiment of the present invention, the framing members 3 will comprise wooden studs cut to length and assembled and secured in the framing channels 24 of the insulated panel 2. However, a framing member(s) which are engineered and manufactured from a single piece of material are also contemplated.

In a preferred embodiment of the method of the present invention, the building wall 1 will be assembled by laying the insulated panel 2 on the flooring surface 132 of the structure to be built such that the insulated panel 2 is laying horizontal with the exterior surface 27 facing upward, the bottom edge 123 positioned substantially along the corresponding edge of the flooring surface 132. The framing members 3 are then placed into the framing channels of the insulated panel 2. In a preferred embodiment of the method of the present invention, the framing members 3 are secured within the framing channels 24. In a particularly preferred embodiment, the framing members 3 are secured within the framing channels 24 using an adhesive in conjunction with mechanical fasteners. The insulated panel 2 with the framing members 3 positioned therein is then raised to the vertical position and secured to the flooring surface 132 to form a building wall 1 of the intended building structure. The same method is then used to form each of the subsequent walls of the intended building structure. When the four walls of the building structure are erected upon and secured to the flooring surface 132, the second level is then installed upon the four walls. The second level may be a second floor or may be a roof. If the second level is a roof, the trusses or rafters of the roof will interface with the truss channels 246 of the upper insulated course 28. Likewise, if the second level is another floor, the stringers of the second floor will interface with the truss channels 246 of the upper insulated course 28.

It will be readily apparent to one skilled in the art that there are numerous means of securing the framing members within the framing channels including, for example, epoxies, screws, nails, or the like. Although in the preferred embodiment of the present invention the framing members are secured within the framing channels using an adhesive in conjunction with mechanical fasteners, other means of securing the framing members within the framing channels are also contemplated. As used herein the description of "applying adhesive" to a particular element shall encompass circumstances where adhesive is applied directly to the particular element which is then affixed to another element, as well as circumstances where adhesive is indirectly applied to a particular element by applying the adhesive directly to another element and affixing the particular element thereto. For example, the phrase "applying adhesive to the framing member" shall encompass circumstances where adhesive is applied directly to the framing member which is subsequently inserted into a framing channel, as well as circumstances where adhesive is applied directly to the framing channel into which the framing member is inserted.

As used herein the term "flooring surface" shall refer to any form of horizontal building surface. It will be readily apparent to those skilled in the art that there are many forms of horizontal building surfaces. For example, flooring surface 132 may refer to a concrete slab, a wooden floor, or the like. The flooring surface 132 will preferably be an insulated floor assembly of the present invention.

Figure 4:
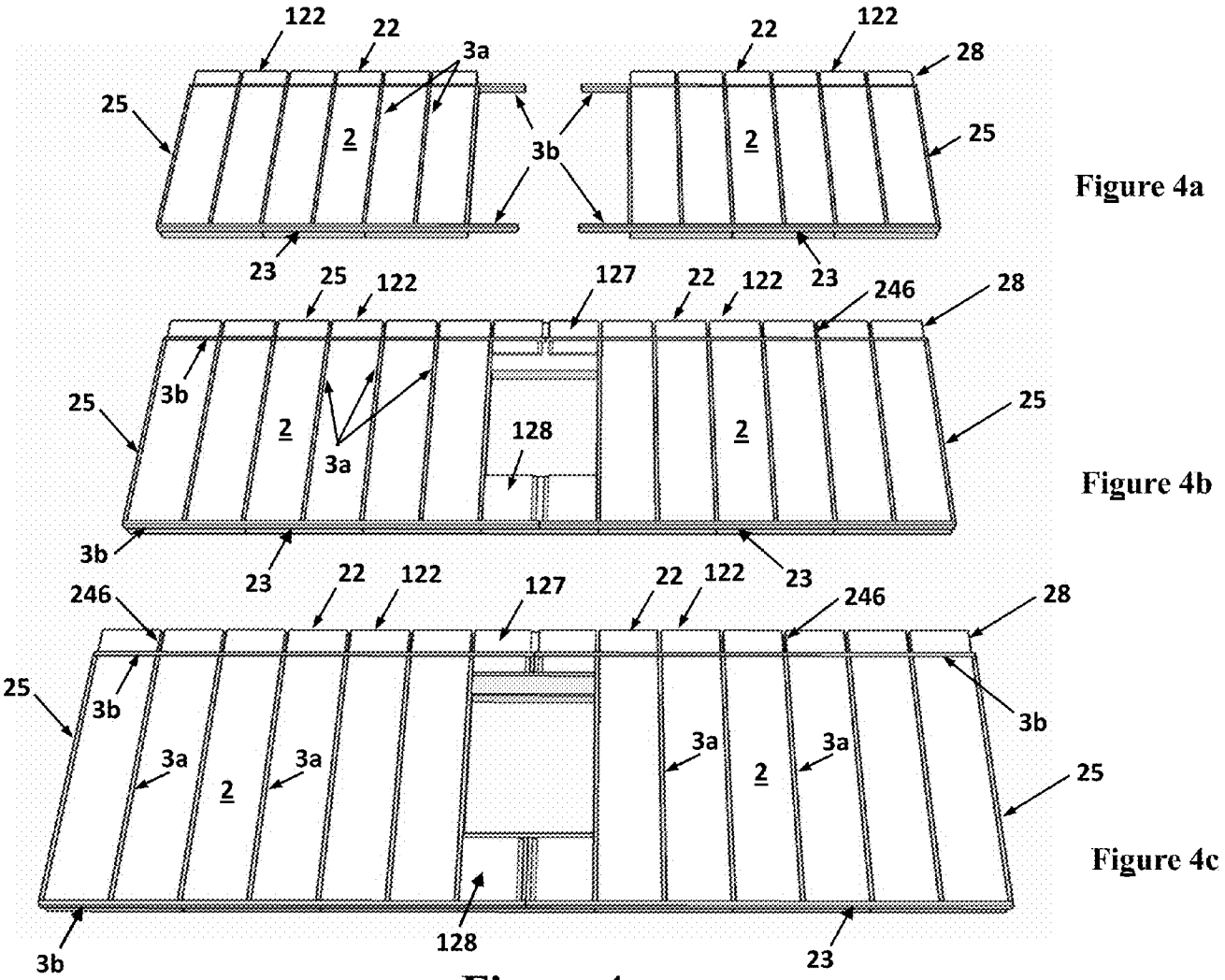
FIGS. 4*a*-4*c* are a series of perspective views of a preferred embodiment of the present invention showing the construction and various stages of assembly of a building wall of the present invention having a window opening.
Figure 5:
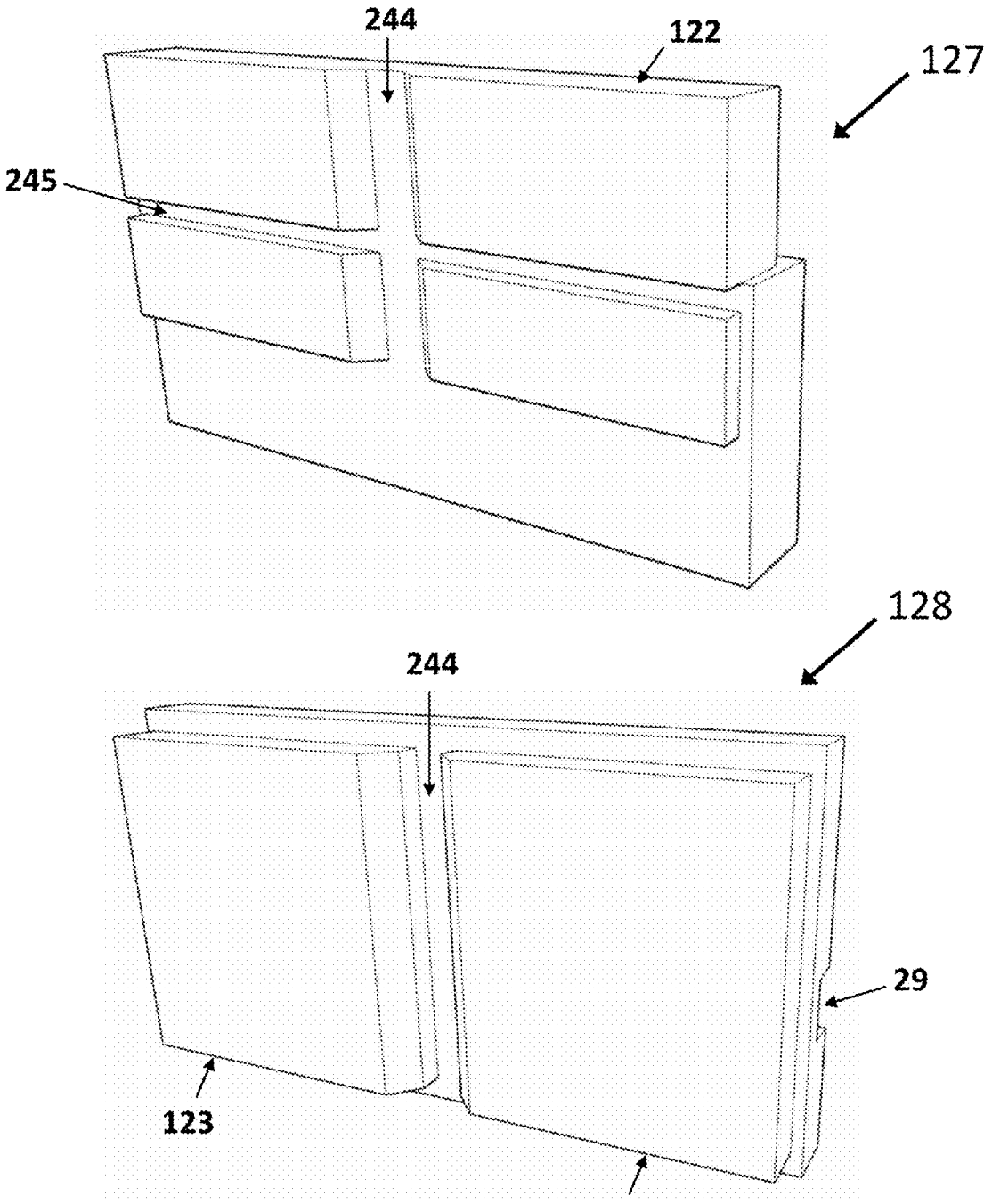
FIG. 5 is a perspective view of a preferred embodiment of a window header and window base for use in the building wall of the present invention.

Referring to FIGS. 4 and 5, shown is a method of assembling a building wall 1 of the present invention having a window opening. The fenestration assemblies (such as window and door assemblies) are intended to be used as connections to panel assemblies. Assembled wall panels will be erected and the window/door (fenestrated opening) headers and footers will be used to "bridge" the wall assemblies. This allows for easier construction in the field, and more simplified fabrication of the panels, and allows for the ability to adjust/customize fenestration sizes.

In a preferred embodiment, the window opening will comprise a header panel 127 and a footer panel 128. The header panel 127 and footer panel 128 will comprise vertical framing channel 244 and horizontal framing channel 245 which will align with and be a continuation of the vertical framing channel 244 and horizontal framing channel 245 of the insulated panel 2. The header panel 127 and footer panel 128 will function as continuations of the insulated panel 2 along the upper and lower portions of the insulated panel 2. The header panel 127 and footer panel 128 will preferably be comprised of the same material as the insulated panel 2.

Although FIG. 4 shows a building wall of the present invention having a single window, it will be readily apparent to one skilled in the art that a building wall 1 having multiple windows can also be constructed using the method and insulated panels of the present invention.

Figure 6:
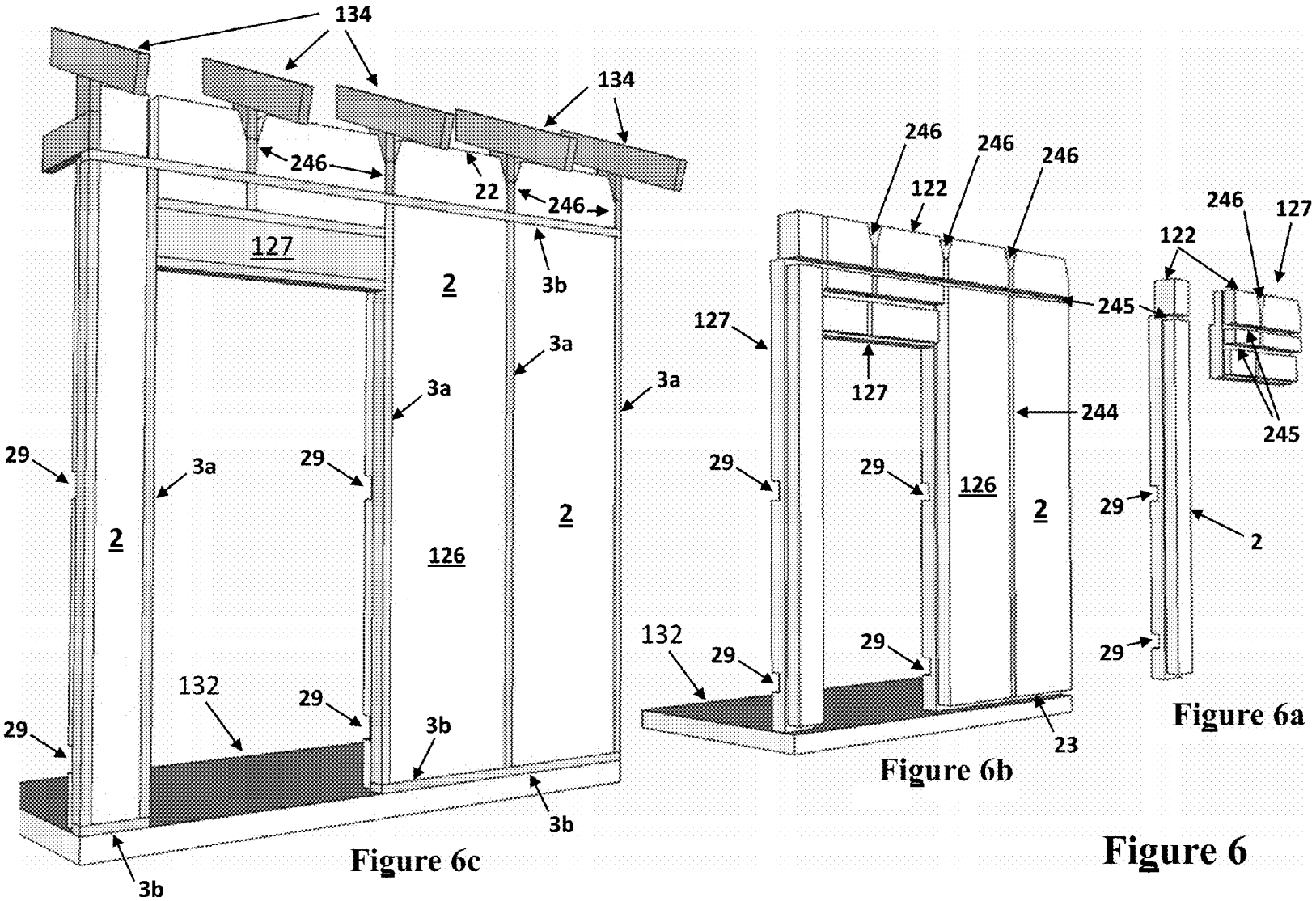
FIGS. 6*a*-6*c* are a series of perspective views of a preferred embodiment of a door header for use in the building wall of the present invention in various stages of assembly.

FIG. 6*a*-6*c* show a method of assembling a building wall 1 of the present invention having a door opening. As described previously with respect to all fenestrations, the door assembly is intended to be used as a connection between panel assemblies. Assembled wall panels will be erected and the door header 127 will be used to "bridge" the wall assemblies. Although FIG. 6 shows a building wall 1 of the present invention having a single door, it will be readily apparent to one skilled in the art that a building wall 1 having multiple door openings or a building wall 1 having a door opening(s) and a window opening(s) can also be constructed using the method and insulated panels of the present invention. FIG. 6*c* also shows roof trusses/rafters 134 interfacing with truss channels 246 of the upper insulated course 28.

Figures 7, 7A, 7B:
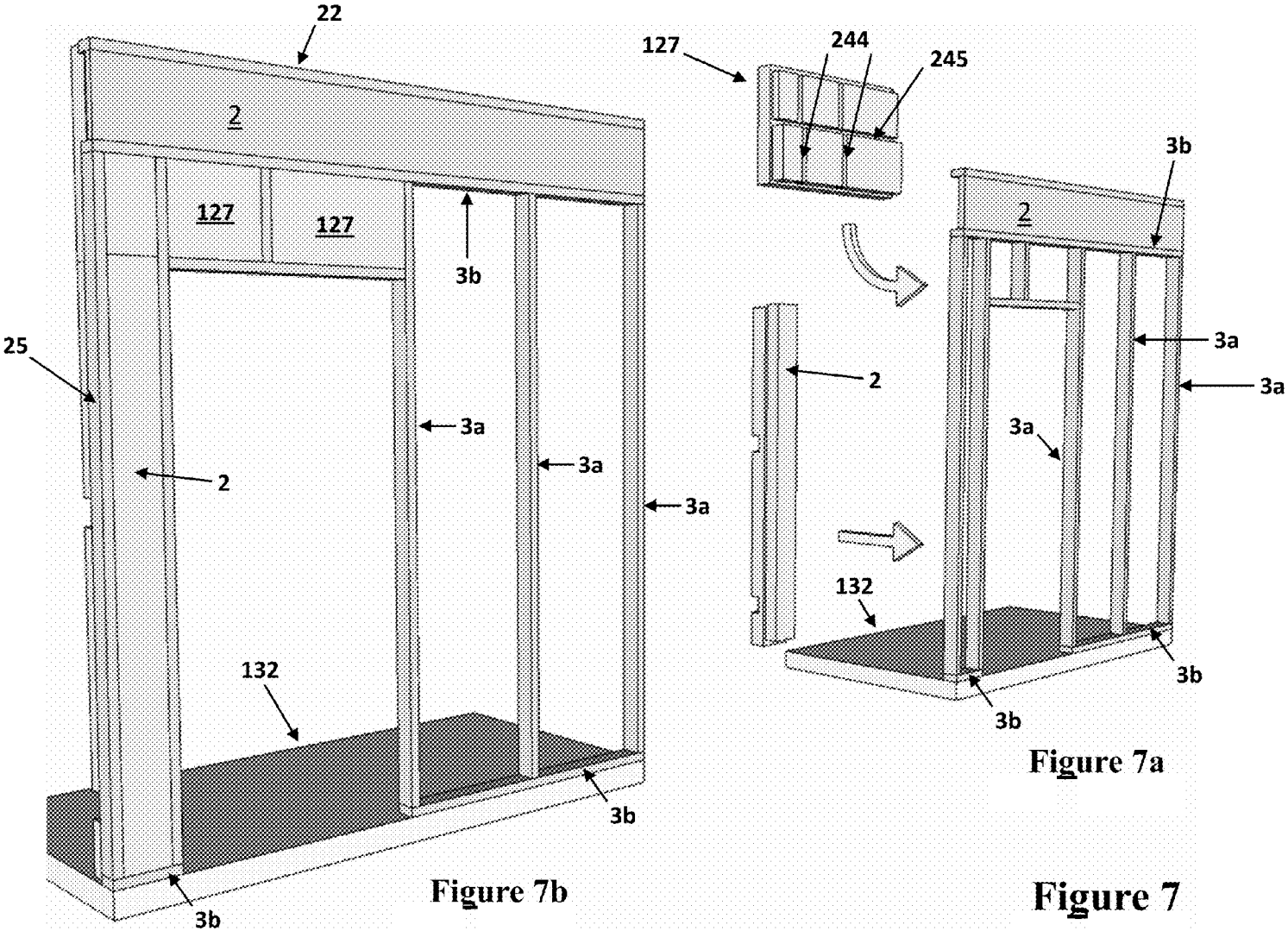
FIGS. 7*a* and 7*b* are a series of perspective, exterior views of an alternate embodiment of a door header in various stages of assembly.
Figure 9:
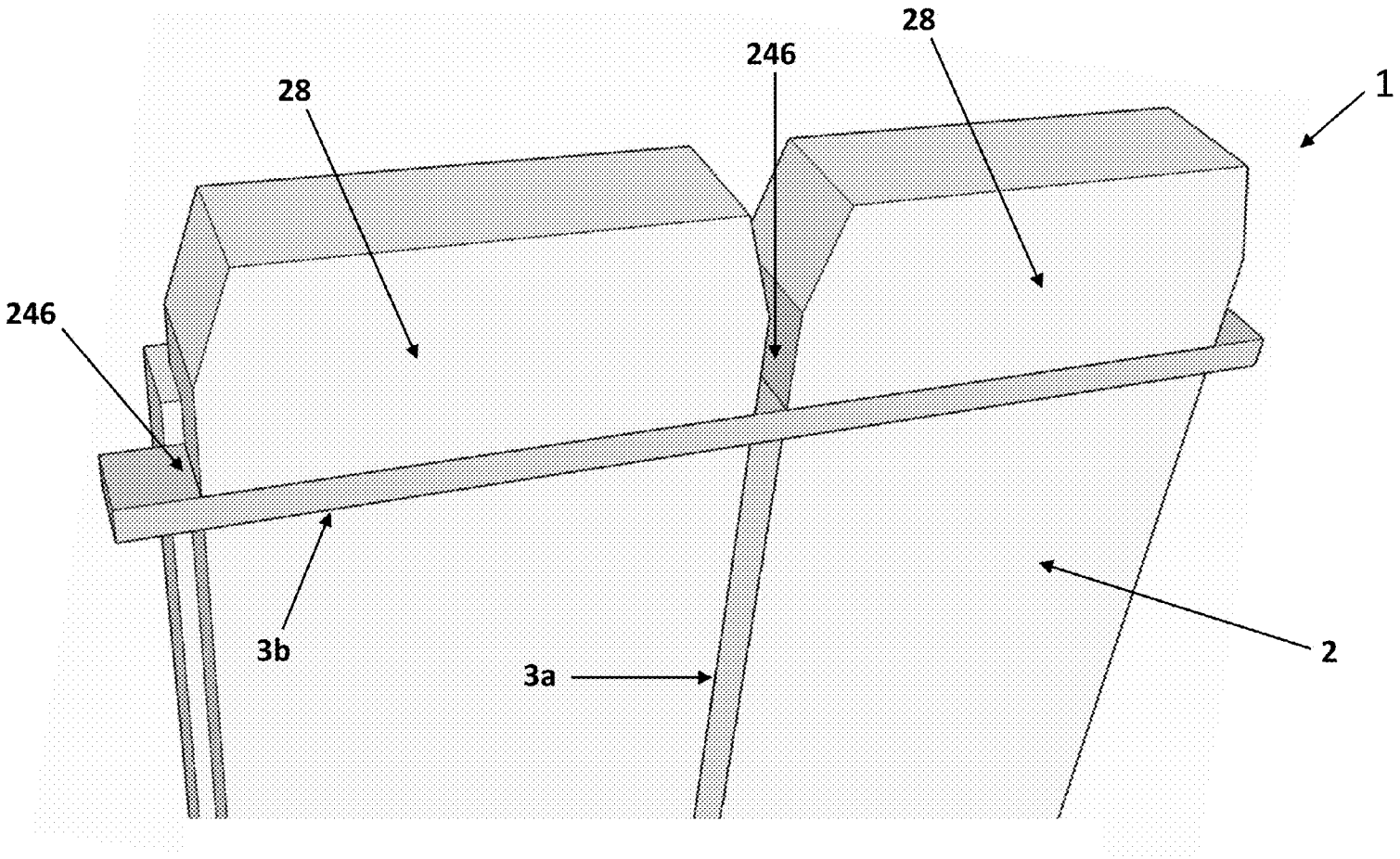
FIG. 9 is a perspective view of the top portion of a building wall 1 of the present invention.

FIGS. 7 and 8 are a series of perspective views of an alternate embodiment of a door header 127 in various stages of assembly. FIG. 9 is a perspective view of the top portion of a building wall 1 of the present invention showing one method of mechanically securing horizontal framing members 3*b* to vertical framing members 3*a* by drill-screwing the framing members 3 together within the truss channels 246 of the upper insulated course 28 using drill 129. Other methods of mechanically securing the framing members 3 will be readily apparent to one skilled in the art.

FIGS. 10*a* and 10*b* show a preferred embodiment of an insulated flooring assembly 301 of the present invention. The insulated flooring assembly 301 comprises a length 322 and a width 333 forming an outer perimeter 36. The insulated flooring assembly 301 also comprises a series of stringers 33 running substantially equidistant from each other along the length 322 of the flooring assembly 301. The flooring assembly also comprises outer insulated panels 32 that run along the outer perimeter 36 and inner insulated panels 34. The inner insulated panels 34 and outer insulated panels 32 comprise stringer channels on the underside to receive the stringers 33. The stringer channels are much like the vertical framing channels 244 of the insulated panel 2 of the building wall 1 of the present invention. The stringer channels allow the inner insulated panels 34 and the outer insulated panels 33 to be lowered onto the stringers 33 from above such that the stringers 33 will be positioned within the stringer channels. Preferably the stringers 33 are secured into the stringer channels by joining the stringers 33 to the stringer channels using adhesive and/or mechanical fasteners. In a particularly preferred embodiment, the outer insulated panels 32 will comprise sill notches 37 to allow space the bottom edge 23 of the building walls 1 to interface with the outer insulated panels 32. The inner insulated panels 34 will preferably be staggered as shown in FIG. 10. The outer insulated panels 32 and the inner insulated panels 34 of the flooring assembly 301 may be comprised of any material suitable for such use and may be comprised of the same material(s) used for the insulated panels 2 of the building wall 1. Alternatively, the outer insulated panels 32 and the inner insulated panels 34 of the flooring assembly 301 may be comprised of material(s) with greater strength and resilience.

Figure 11:
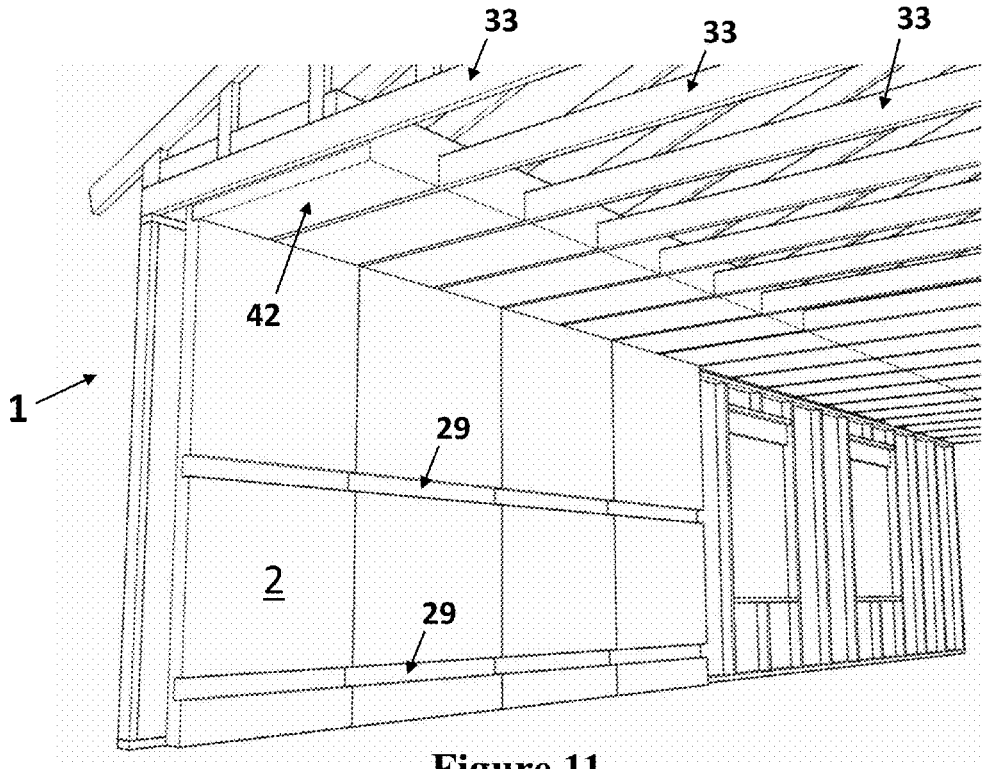
FIG. 11 is a perspective view of a partially assembled building structure of the present invention showing a building wall and insulated ceiling panels.
Figure 12:
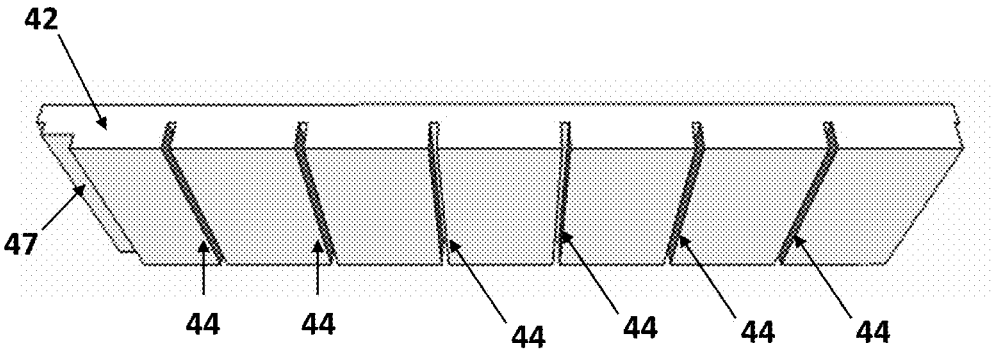
FIG. 12 is a perspective view of a preferred embodiment of an insulated ceiling panel of the present invention.

FIG. 11 is a perspective view of a partially assembled building structure of the present invention showing a building wall 1 and insulated ceiling panels 42 which are positioned on the stringers 33 of the ceiling framing. FIG. 12 is a perspective view of a preferred embodiment of the insulated ceiling panel 42 of the present invention showing stringer channels 44 for receiving the stringers 33 of the ceiling framing. In a preferred embodiment, the insulated ceiling panel 42 will also comprise a notch 47 to allow the insulated ceiling panel 42 to interface with the top edge 122 of the insulated panel 2 and/or the top edge 22 of the building wall 1. The insulated ceiling panels 42 may be comprised of any material suitable for such use and may be comprised of the same material(s) used for the insulated panels of the flooring assembly 301 and/or the insulated panels 2 of the building wall 1.

What is claimed is:

1. An insulated panel for receiving framing members and positioning said framing members for constructing a building structure, said insulated panel comprising:

an exterior surface, an interior surface, a top edge, a bottom edge, a plurality of vertical recessed framing channels, and an upper horizontal recessed framing channel and a lower horizontal recessed framing channel;

said vertical recessed framing channels, said upper horizontal recessed framing channel, and said lower horizontal recessed framing channel being located on the exterior surface of said insulated panel and being recessed inward from the exterior surface of said insulated panel;

each of said vertical recessed framing channels, said upper horizontal recessed framing channel, and said lower horizontal recessed framing channel being configured to have said framing members secured therein;

said upper horizontal recessed framing channel being arranged substantially parallel to said top edge, and said lower horizontal recessed framing channel being arranged substantially parallel to said bottom edge;

said vertical recessed framing channels being arranged substantially perpendicular to said top edge; and an upper insulated course that extends from said upper horizontal framing channel to said top edge, said upper insulated course comprising a plurality of truss channels, said truss channels being substantially perpendicular with said top edge and being collinear with said vertical recessed framing channels and extending from said upper horizontal framing channel to said top edge;

said truss channels being configured to have roof rafters, roof trusses, or stringers for an upper floor of the building structure secured therein;

wherein said insulated panel is a single, substantially unitary and continuous piece of insulating material;

wherein when said insulated panel is secured to other insulated panels and said framing members are secured in said vertical recessed framing channels, said upper horizontal recessed framing channel and said lower recessed channel, an insulated building wall is formed for said building structure.

2. The insulated panel of claim 1 wherein said insulated panel is comprised of polystyrene.

* * * * *